US010090145B2

(12) United States Patent
Shi et al.

(10) Patent No.: US 10,090,145 B2
(45) Date of Patent: Oct. 2, 2018

(54) SYSTEM AND METHOD FOR TESTING THE CHEMICAL CONTENT OF PLASTIC CONTAINERS MOVING ALONG A TEST LINE

(71) Applicant: Enos Engineering, LLC, Acton, MA (US)

(72) Inventors: Quan Shi, West Roxbury, MA (US); Allan S. Tseng, Chelmsford, MA (US)

(73) Assignee: Enos Engineering, LLC, Acton, MA (US)

( * ) Notice: Subject to any disclaimer, the term of this patent is extended or adjusted under 35 U.S.C. 154(b) by 210 days.

(21) Appl. No.: 15/205,526

(22) Filed: Jul. 8, 2016

(65) Prior Publication Data

US 2018/0012749 A1 Jan. 11, 2018

(51) Int. Cl.

| | |
|---|---|
| ***H01J 49/24*** | (2006.01) |
| ***B67C 3/00*** | (2006.01) |
| ***H01J 49/00*** | (2006.01) |

(52) U.S. Cl.

CPC ..... *H01J 49/24* (2013.01); *B67C 3/007* (2013.01); *H01J 49/0031* (2013.01)

(58) Field of Classification Search

None

See application file for complete search history.

(56) References Cited

U.S. PATENT DOCUMENTS

| | | | | |
|---|---|---|---|---|
| 5,067,616 A | | 11/1991 | Plester et al. | |
| 5,108,705 A | | 4/1992 | Rounbehler et al. | |
| 5,318,911 A | * | 6/1994 | Fine | B07C 5/34 422/82.05 |
| 5,365,771 A | * | 11/1994 | Gysi | B08B 9/46 73/31.03 |
| 5,558,836 A | * | 9/1996 | Rounbehler | G01N 21/15 356/218 |
| 5,569,606 A | * | 10/1996 | Fine | G01N 1/2226 422/80 |
| 6,013,228 A | * | 1/2000 | Achter | B07C 5/34 209/3.1 |
| 6,130,093 A | * | 10/2000 | Dussault | G01N 21/9018 209/552 |

FOREIGN PATENT DOCUMENTS

| | | |
|---|---|---|
| CA | 2099957 | 1/1994 |
| DE | 4306833 | 8/1994 |
| EP | 0 623 820 | 11/1994 |

* cited by examiner

*Primary Examiner* — Paul West
*Assistant Examiner* — Mark A Shabman
(74) *Attorney, Agent, or Firm* — John W. Powell; Verrill Dana, LLP

(57) ABSTRACT

A system for testing the chemical content of a plurality of plastic containers continuously moving along a test line. The system includes a detector maintained at a first vacuum level for sequentially receiving a sample of air from each of the plurality of plastic containers as they move along the test line and for detecting the chemical content of each of the samples. There is a conduit including a first end proximate the plurality of plastic containers and a second, remote end. There is a sensor module interfacing the conduit between its first end and the second ends. There is also a vacuum pump interconnected to the second end of the conduit to maintain the interior of the conduit at a second, lower vacuum level and to establish an airflow rate to sequentially withdraw and transport air samples from the plastic containers to the sensor module.

26 Claims, 5 Drawing Sheets

SYSTEM AND METHOD FOR TESTING THE CHEMICAL CONTENT OF PLASTIC CONTAINERS MOVING ALONG A TEST LINE

FIELD OF INVENTION

This invention relates to a system and method for testing the chemical content of a plurality of plastic bottles continuously moving along a test line, and more particularly to such a system and method using a mass spectrometer to test the chemical content of the containers.

BACKGROUND

Vapor analysis systems are designed to detect and remove from further use consumer returned contaminated plastic Polyethylene Terephthalate (PET) refillable bottles, which may be used for soft drinks, water, and other beverages. In certain regions of the world, in particular, Latin America, soft drinks are sold to consumers in PET bottles with a deposit. Upon return, the PET bottles are washed and refilled. Prior to refilling, the bottles are inspected for consumer added contaminants using an automated inspection system. If a contaminant is detected, the bottle is automatically removed from the production line and destroyed. The non-contaminated bottles continue on to be washed, cleaned, and refilled.

Before returning the PET bottles for the deposit, consumers may use empty bottles for various purposes, such as storage of household products, gasoline, mineral spirits, or for storing other types of beverages. Detecting and rejecting contaminated bottles is thus very important for beverage/bottling companies, as sale of beverages in contaminated bottles may result in a bad experience for the user, or worse, health problems. This can result in reputational damage and lost business for the beverage/bottling companies.

Companies use so called "hydrocarbon sniffers" in their refilling lines to detect and reject contaminated bottles as they are moved along a conveyor before they are cleaned and refilled. Sniffers have used various technologies to detect contamination, including photo-ionization detection, chemiluminescence, and electron capture detection. One such system is described in U.S. Pat. No. 5,318,911, entitled "System for Sampling and Detecting the Presence of Compounds in Containers." These systems work well for detecting certain levels of contamination; however, there is a need for detection systems that are capable of more sensitive detection, i.e. detecting lower levels of contamination than the above described detectors would not detect.

Mass spectrometer ("mass spectrometer") technology was tested as a potential basis of for a more sensitive contamination detection system in the refillable PET bottles, but has generally been considered unreliable and prone to malfunction and excessive false reject levels. The problem with mass spectrometer technology is that it operates poorly in an industrial environment where highly concentrated NOx and hydrocarbon bottles contaminate and overwhelm these very sensitive detectors, causing them temporarily go "blind" and not be capable of testing. At the speed of the typical inspection conveyor line, when the mass spectrometer goes blind, it will miss 15 to 20 bottles or more before it is able to detect contaminates again. While more sensitive and able to better detect contaminates, mass spectrometer detection has proven to be inefficient in high volume production applications.

SUMMARY

It is therefore an object of the invention to provide a vapor analysis system and method which enables greater sensitivity in detecting contaminates in plastic containers.

It is a further object of the invention to provide such a system and method which is highly efficient and reliable in high volume production applications.

In one aspect, the invention features a system for testing the chemical content of a plurality of plastic containers continuously moving along a test line. There is a detector for sequentially receiving a sample of air from each of the plurality of plastic containers as they move along the test line and for detecting the chemical content of each of said samples, wherein the detector is maintained at a first vacuum level. There is a conduit including a first end proximate the plurality of plastic containers moving along the test line and a second end, remote from the first end and a sensor module of the detector interfaces an interior of the conduit between the first end and the second end of the conduit. There is included a vacuum pump interconnected to the second end of the conduit and configured to maintain the interior of the conduit at a second vacuum level lower than the first vacuum level and configured to establish a rate of airflow sufficient to sequentially withdraw the samples of air from the plurality of plastic containers and transport the samples in the conduit to the sensor module of the detector.

In other aspects of the invention one or more of the following features may be included. The first vacuum level may be maintained at less than $1*10^{-3}$ Torr and the second vacuum level may be maintained at less than 760 Torr. The first vacuum level may be maintained at approximately $5*10^{-5}$ Torr and the second vacuum level may be maintained at approximately 40 Torr. The plastic containers may move along the test line at a rate of 300-600 containers per minute and the samples of air from the plastic containers may be transported in the conduit at an airflow rate approximately equal to the speed of sound. The detector may further include a detection chamber maintained at the first vacuum level and the sensor module includes a tube having a first end disposed in the detection chamber and a second end disposed in the conduit; wherein, due to the pressure differential between the first and second ends of the tube, a portion of each of said air samples sequentially flows through the tube from the second end to the first end and into the detection chamber to be tested for chemical content by the detector. The tube may comprise a glass lined tube with an inner diameter of approximately 0.18 mm. The detector may comprise a mass spectrometer for testing the chemical content of the air samples from the plurality of plastic containers. There may further be included a heater for heating the interior of the conduit. The heater may be configured to heat the interior of the conduit to approximately 105 degrees Celsius and the heater may include a heating element disposed on the exterior of the conduit. There may further be included a compressed air injector configured to sequentially inject compressed air into each of the plurality of plastic containers in order to displace a portion of the contents thereof, from which said samples of air are withdrawn into the conduit by the vacuum pump. The second end of the conduit may include an orifice having a diameter of approximately 200-500 microns. The plastic containers may be plastic Polyethylene Terephthalate (PET) refillable bottles.

In another aspect, the invention features a method for testing the chemical content of a plurality of plastic containers continuously moving along a test line. The method includes sequentially receiving by a detector a sample of air from each of the plurality of plastic containers as they move along the test line and detecting the chemical content of each of said samples in an environment at a first vacuum level. The method also includes providing a conduit including a first end proximate the plurality of plastic containers moving along the test line and a second end, remote from the first end; a sensor module of the detector interfacing an interior of the conduit between the first end and the second end of the conduit. The method further includes suctioning by a vacuum pump from the second end of the conduit to maintain the interior of the conduit at a second vacuum level lower than the first vacuum level and to establish a rate of airflow sufficient to sequentially withdraw the samples of air from the plurality of plastic containers and transport the samples in the conduit to the sensor module of the detector.

In further aspects of the invention one or more of the following features may be included. 15. The first vacuum level may be maintained at less than $1*10^{-3}$ Torr and the second vacuum level may be maintained at less than 760 Torr. The first vacuum level may maintained at approximately $5*10^{-5}$ Torr and the second vacuum level may be maintained at approximately 40 Torr. The plastic containers may move along the test line at a rate of 300-600 containers per minute and the samples of air from the plastic containers may be transported in the conduit at an air sample speed. The method may include providing the detector with a detection chamber maintained at the first vacuum level and providing the sensor module with a tube having a first end disposed in the detection chamber and a second end disposed in the conduit; wherein, due to the pressure differential between the first and second ends of the tube, a portion of each of said air samples sequentially flows through the tube from the second end to the first end and is tested for chemical content by the detector. The tube may comprise a glass lined tube with an inner diameter of approximately 0.18 mm. The detector may comprise a mass spectrometer for testing the chemical content if the air samples from the plurality of plastic containers. The method may further include heating the interior of the conduit. The interior of the conduit may be heated to approximately 105 degrees Celsius. The step of heating the interior of the conduit may include disposing a heating element on the exterior of the conduit. The method may further include sequentially injecting compressed air into each of the plurality of plastic containers in order to displace a portion of the contents thereof, from which said samples of air are withdrawn into the conduit by the suction provided by the vacuum pump. The second end of the conduit may be provided with an orifice having a diameter of approximately 200-500 microns. The plastic containers may be plastic Polyethylene Terephthalate (PET) refillable bottles.

These and other features of the invention will be apparent from the following detailed description and the accompanying figures, in which:

DETAILED DESCRIPTION

Figure 1:
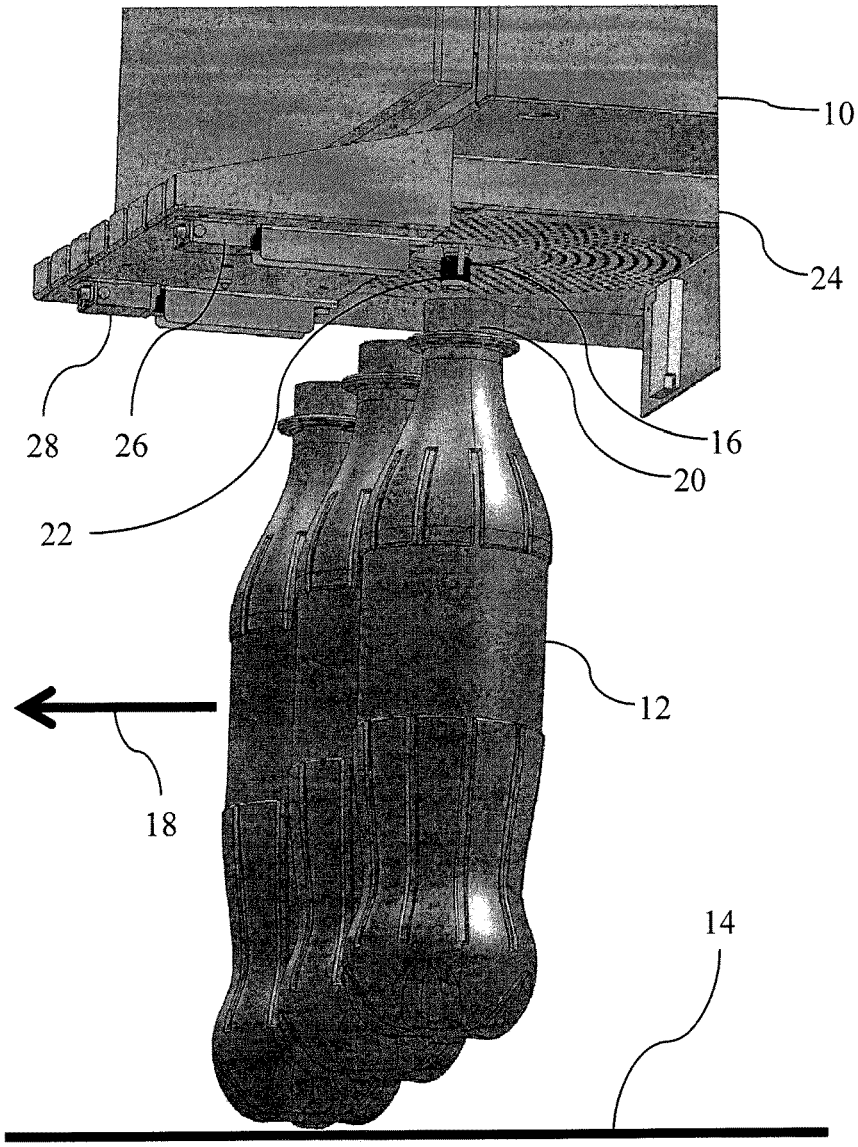
FIG. 1 is a perspective view of a portion the mass spectrometer inspection station according to an aspect of this invention implemented in a bottle conveyor line.

To assist in understanding of the invention, a preferred embodiment will be described in detail below. There is shown in FIG. 1 a portion of mass spectrometer inspection station 10, which may be operated as a stand-alone unit to inspect PET bottles 12 (or other plastic containers) moving along a conveyor line 14 of a PET production line. Alternatively, it may be integrated into a multi-station or multi-barrier system, which could include one or more less sensitive upstream detectors, such as the system described in U.S. Pat. No. 5,318,911, and use mass spectrometer inspection station 10 as the final inspection station to safeguard the production line from any contaminated bottles that would not be detected by the other detectors.

With a multi-barrier system, the upstream detectors detect and reject highly concentrated NOx and hydrocarbon bottles prior to inspection by the mass spectrometer inspection station 10, allowing the mass spectrometer inspection station 10 to operate at sensitive detection levels without becoming "blind" and causing high false reject levels.

Referring again to FIG. 1, mass spectrometer inspection station 10 includes a compressed air injector 16 for injecting compressed air into the PET bottles 12 as they move in the direction of arrow 18 along the conveyor line 14 to displace a portion of the contents of the bottles and produce outside the mouth 20 of the bottle 12 a cloud of air containing any residues of contaminants that may have been stored in the bottles. Inlet 22 located slightly downstream of air injector 16 and in fluid communication with the cloud of air produced outside of mouth 20 of bottle 12 includes an orifice (not shown in this view) through which a sample from the air cloud is suctioned into a conduit (not shown in this view) for testing. Mass spectrometer inspection station 10 also includes air hood 24 for circulating air to provide a clean air environment. The system also includes sensors 26 and 28. Sensor 26 senses incoming bottles to trigger the compressed air injection from air injector 16 and sampling of air by inlet 22. Sensor 28 is a reject location sensor to detect the position of rejected bottles as the travel along line 14.

Figure 2:
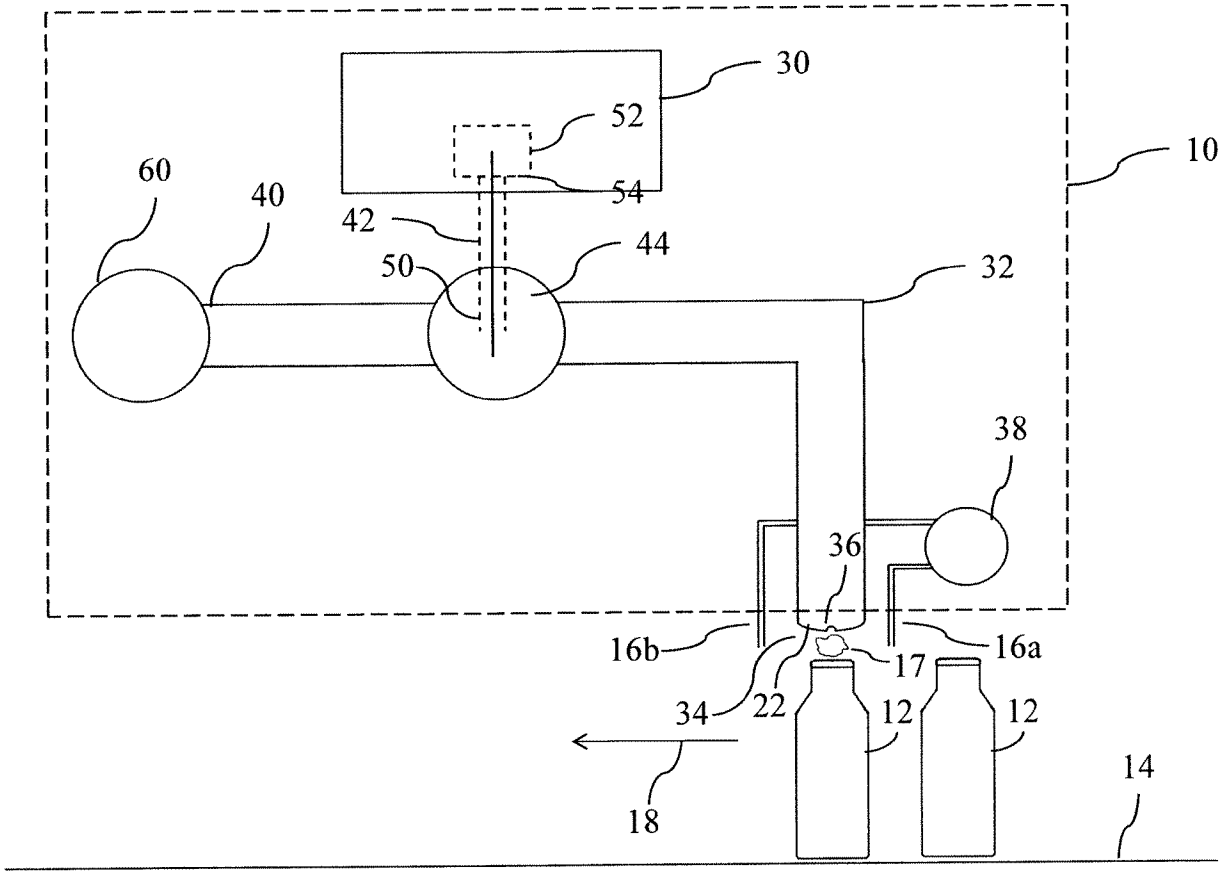
FIG. 2 is a block diagram of the mass spectrometer inspection station of FIG. 1.
Figure 3:
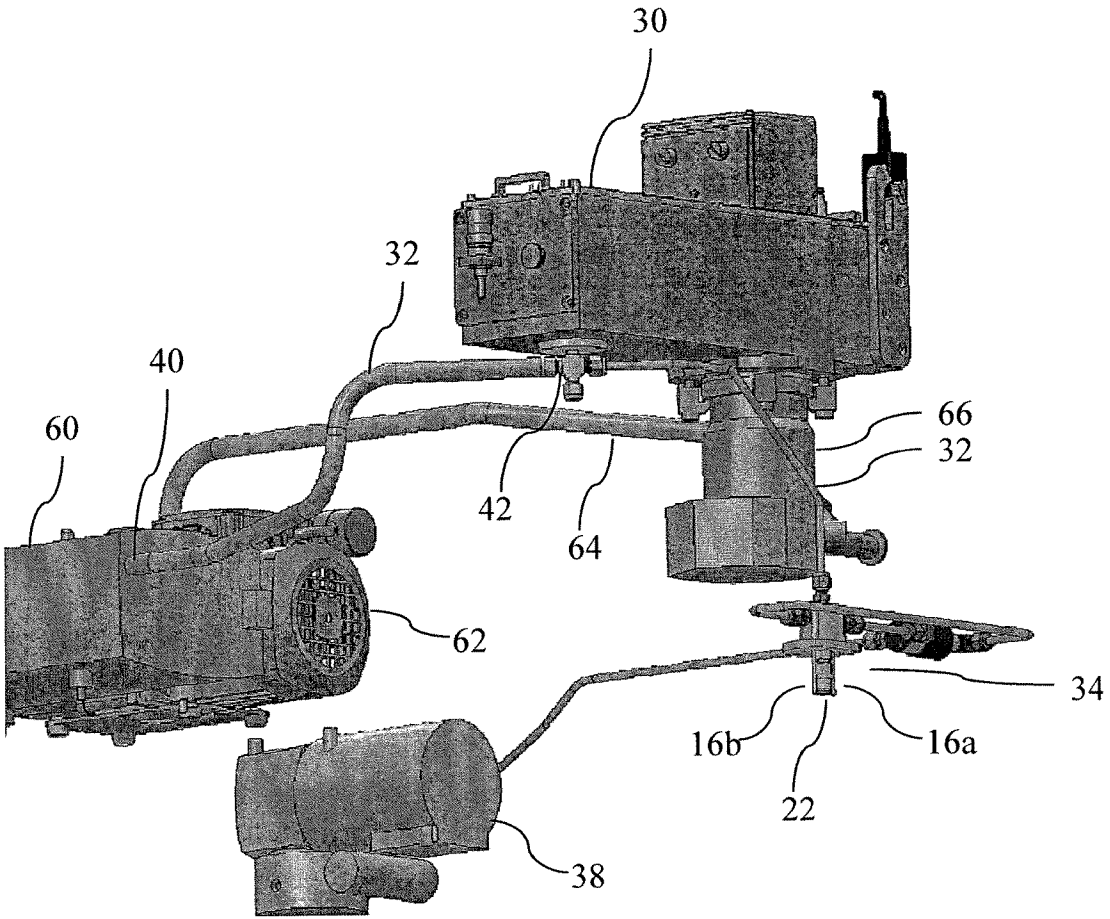
FIG. 3 is a perspective view of the mass spectrometer inspection station of FIG. 2.

Mass spectrometer inspection station 10 is shown in more detail in FIGS. 2 and 3 to include mass spectrometer detector 30 such as an EA 8800 made by Everise Analytical of Santa Clara Calif., for sequentially receiving air samples 17 from the bottles 12 and for detecting the chemical content of the samples to determine if they are contaminated. Conduit 32, which may be formed of a metal, includes a first end 34 proximate bottles 12 moving along the conveyor 14. At first end 34 are inlet 22, which includes orifice 36 through which the air samples 17 are suctioned, and air injectors 16*a,b* driven by compressed air source 38. Two air injectors 16*a,b* are included so that the conveyor line 14 may run in either direction. When the conveyor line 14 runs in the direction of arrow 18, air injector 16*a* is active so that it will be upstream of inlet 22. When conveyor line 14 runs in the opposite direction, air injector 16*b* is active so that it will be upstream of inlet 22.

As bottles 12, approach air injector 16*a,b* they are sensed by sensor 26, FIG. 1, and compressed air is injected by injector 16 at the correct time to displace a portion of the contents of the bottles and produce outside the mouth 20 of the bottle 12 air sample 17 containing any residues of contaminants that may have been stored in the bottles Conduit 32 also includes a second end 40, remote from the first end 34. Mass spectrometer detector 30 includes a sensor manifold 42 which interfaces at its first end 50 with interior 44 of the conduit 32 between the first end 34 and the second end 40. Mass spectrometer detector 30 includes a detection chamber 52 inside its housing with which the second end 54 of sensor manifold 42 interfaces.

There is a vacuum pump 60 interconnected to the second end 40 of conduit 32. Vacuum pump 60 is configured to maintain the interior 44 of conduit 32 at a pressure level below ambient pressure (i.e. less than 760 Torr), preferably at vacuum level of 40-60 Torr. The capacity of the vacuum pump 60, the diameter of the conduit 32, and the diameter of orifice 36 are sized to achieve the desired vacuum level as well as to establish a rate of airflow sufficient to sequentially withdraw the samples of air from the bottles 12 and transport the samples in conduit 32 to the sensor manifold 42 at a high enough rate of speed to enable the sampling by the mass spectrometer 30 to occur rapidly enough to keep pace with the bottle flow on the conveyor 14, which is typically in the range of 300-600 bottles per minute. The airflow rate in conduit 32 is typically set at critical velocity, i.e. approximately the speed of sound. In order to achieve this in the preferred embodiment, the diameter of stainless steel orifice 36 is set to 200-500 microns. In this way, the samples are rapidly transported to the mass spectrometer detector 30 and tested for contamination sufficiently quickly for a communication to be sent to a rejection station (not shown) for removal of the contaminated bottles from the production line.

The mass spectrometer detector 30 is capable of completing sample detection in approximately 40 msec and with the designed airflow rate, the full sample cycle time is approximately 100 msec, which is sufficient to handle the bottle flow rate of 300-600 bottles per minute. The sample results (i.e. chemical content or reject/no reject based on chemical content) are time stamped and provided to a downstream bottle rejection system.

Figure 4:
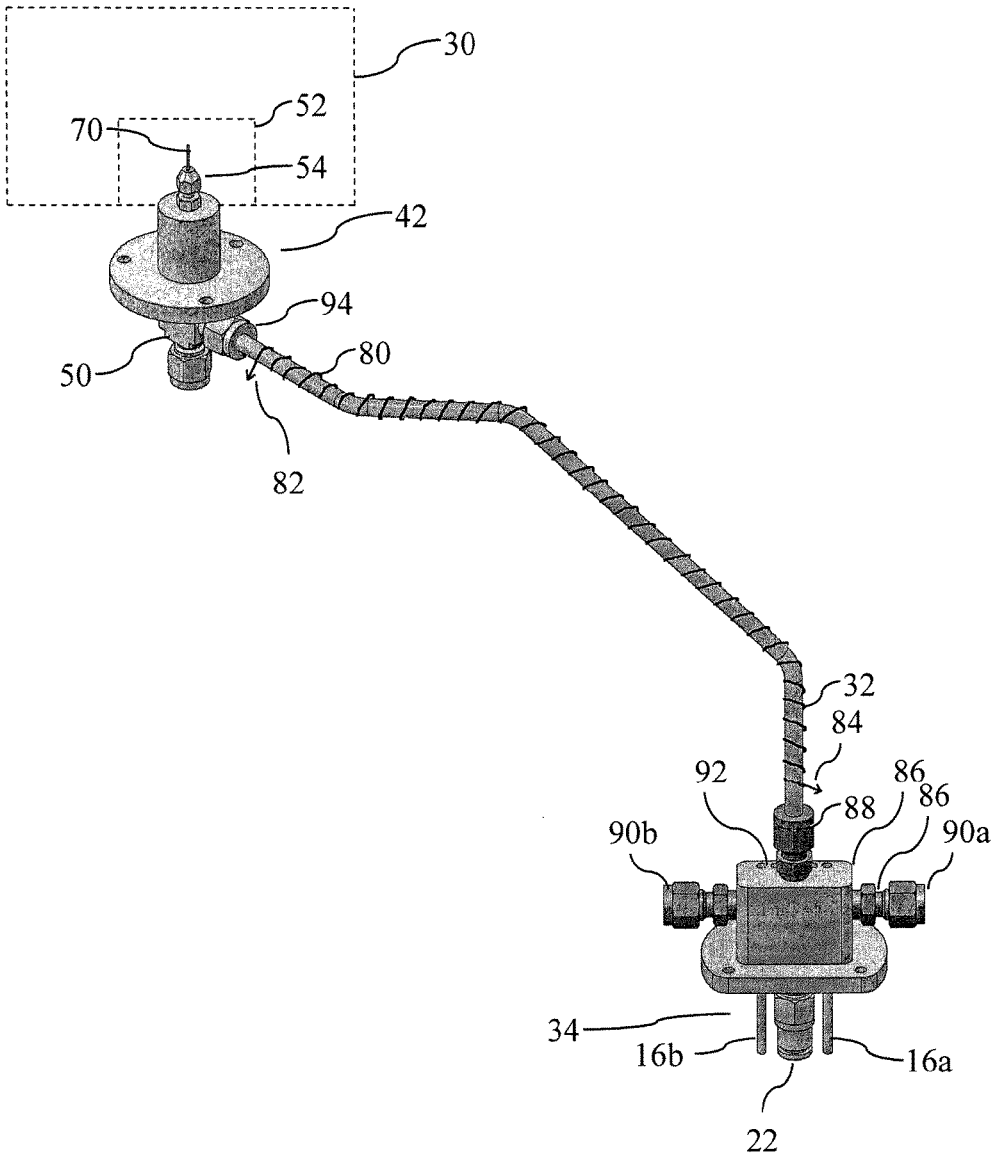
FIG. 4 is a perspective view of a portion of the mass spectrometer inspection station of FIG. 3.
Figure 5:
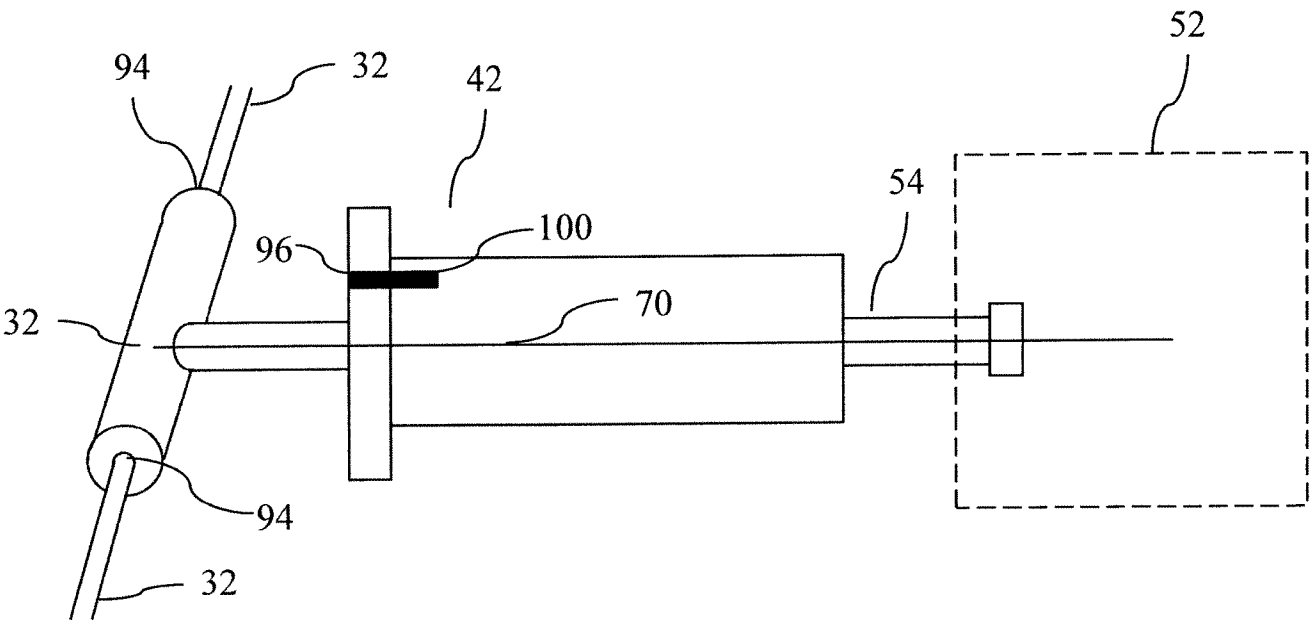
FIG. 5 is a partial cross-sectional view of the sensor manifold of the mass spectrometer inspection station according to an aspect of this invention.

Referring to FIGS. 2 and 5, mass spectrometer detector 30 includes detection chamber 52, which is maintained at high vacuum (e.g. $5*10^{-5}$ Torr). Sensor manifold 42 includes a capillary tube 70, visible in this view at the second end 54 of sensor manifold 42, where it terminates inside detection chamber 52. Capillary tube 70 may be in the form of a hollow, glass lined tube. At its other end, capillary tube 70 terminates in the interior 44 of conduit 32, as shown in FIGS. 4 and 5, which is maintained at a lower vacuum level of approximately 40-60 Torr. In the preferred embodiment, the length of capillary tube 70 is approximately 10 cm with a diameter of 0.18 mm. The length of the capillary tube is dependent on the distance between the interior 44 of the conduit 32 and the detection chamber 52 of the mass spectrometer detector 30.

Due to the pressure differential between the first end 50 and second end 54 of tube 70, a portion of each of said air samples 17 (FIG. 2) sequentially flows through tube 70 and into the detection chamber 52 to be tested for chemical content by the mass spectrometer detector 30. The amount of sample 17 which flows into detection chamber 52 is also dependent on the length and the diameter of capillary tube 70. A desired amount of sample 17 is determined so that there is a sufficient sample size for accurate detection by mass spectrometer detector 30 but not an excessive amount of the sample 17 so as to make the detector go "blind", as described above. With the desired sample size determined, and the conduit 32 vacuum level set to ensure the proper sample size to be delivered due to differential pressure, the diameters of the conduit 32 and orifice 36 may be set to achieve the correct vacuum level while maximizing flow rate in the conduit.

An additional benefit is achieved by locating the detection chamber 52 of mass spectrometer detector 30 remotely from the location of the bottles along the conveyor line and transporting the samples in a vacuum environment in conduit 32. The additional benefit is that it maintains a cleaner environment for better test results with the mass spectrometer which avoids the issue of the mass spectrometer going "blind" as with prior art systems. However, the length of the conduit 32 from the conduit end 34 to sensor manifold 42 should be minimized to reduce sample transport time while maintaining an environment which is clean enough for the mass spectrometer to properly operate.

Referring to FIG. 3, a perspective view of the mass spectrometer inspection station of FIG. 2 is shown. In addition to vacuum pump 60, there is included a roughing pump 62 which is connected to mass spectrometer detector 30 through conduit 62. Roughing pump 62 pumps down detection chamber 52 to approximately $10^{-2}$ Torr. Turbo pump 66 is also connected to mass spectrometer detector 30 and pumps down detection chamber 52 to the desired high vacuum level of approximately $5*10^{-5}$ Torr.

As depicted in FIG. 4, to provide an even cleaner environment, a heater may be applied to conduit 32 to heat interior 44 to prevent particles from adhering to the interior surfaces of conduit 32. This may be accomplished by applying a resistive heating element (having a resistance, for example, of 15 ohms), such as element 80 wound about the exterior of conduit 32. Leads 82 and 84 would be connected to a power source (not shown) to provide an electrical current flow to heat the interior 44 of conduit to a temperature of about 105 degrees Celsius. Although not shown, an insulating wrap, such as a fiberglass tube or a high temperature silicon paste, may be applied around element 80.

First end 34 of conduit 32 terminates in a sample head manifold 86 to which conduit 32 is connected by way of sample fitting 88. The flow path of conduit 32 sample head manifold and terminates at inlet 22 via orifice 36 (not shown in this Fig.). Compressed air line fittings 90*a,b* allow for the compressed air source 38, FIG. 3, to connect to sample head manifold 86 and be expelled out of compressed air nozzles 16*a,b*, respectively. Also, shown are cartridge heater ports 90 which are formed in sample head manifold 86 to accept cartridge heaters to heat the sample head manifold 86 so that the sample flow path is maintained at the temperature interior 44 of conduit 32. Sensor manifold 42 receives conduit 32 at sensor fitting 94 and includes cartridge heater ports 96 to accept cartridge heaters to heat the sensor manifold 42 so that the sample flow path in the interior of sensor manifold is maintained at the temperature interior 44 of conduit 32.

Referring to FIGS. 4 and 5, capillary tube 70 is shown to terminate at second end 54 of sensor manifold 42 inside detection chamber 52 of mass spectrometer detector 30. At the first end 50 of sensor manifold 42, capillary tube 70 terminates in the interior 44 of conduit 32. As described above, interior 44 is maintained at a lower vacuum level of approximately 40-60 Torr. As is visible in FIG. 5, a cartridge heater 100 installed in cartridge heater port 96 is shown to terminate in the interior of sensor manifold 42 to heat the area through which capillary tube 70 passes between ends 50 and 54 in order to maintain a clean environment.

Having described the invention, and a preferred embodiment thereof, what is claimed as new and secured by Letters Patent is:

1. A system for testing the chemical content of a plurality of plastic containers continuously moving along a test line, the system comprising:

a detector for sequentially receiving a sample of air from each of the plurality of plastic containers as they move along the test line and for detecting the chemical content of each of said samples; the detector being maintained at a first vacuum level;

a conduit including a first end proximate the plurality of plastic containers moving along the test line and a second end, remote from the first end; a sensor module of the detector interfacing an interior of the conduit between the first end and the second end of the conduit; and a vacuum pump interconnected to the second end of the conduit and configured to maintain the interior of the conduit at a second vacuum level lower than the first vacuum level and configured to establish an airflow to sequentially withdraw the samples of air from the plurality of plastic containers and transport the samples in the conduit to the sensor module of the detector.

2. The system of claim 1 wherein the first vacuum level is maintained at less than $1 * 10^{-3}$ Torr and the second vacuum level is maintained at less than 760 Torr.

3. The system of claim 2 wherein the first vacuum level is maintained at approximately $5 * 10^{-5}$ Torr and the second vacuum level is maintained at approximately 40 Torr.

4. The system of claim 2 wherein the plastic containers move along the test line at a rate of 300-600 containers per minute and the samples of air from the plastic containers are transported in the conduit at an airflow rate approximately equal to the speed of sound.

5. The system of claim 2 wherein the detector further includes a detection chamber maintained at the first vacuum level and the sensor module includes a tube having a first end disposed in the detection chamber and a second end disposed in the conduit; wherein, due to the pressure differential between the first and second ends of the tube, a portion of each of said air samples sequentially flows through the tube from the second end to the first end and into the detection chamber to be tested for chemical content by the detector.

6. The system of claim 5 wherein the tube comprises a glass lined tube with an inner diameter of approximately .18mm.

7. The system of claim 5 wherein the detector comprises a mass spectrometer for testing the chemical content of the air samples from the plurality of plastic containers.

8. The system of claim 5 further including a heater for heating the interior of the conduit.

9. The system of claim 8 wherein the heater is configured to heat the interior of the conduit to approximately 105 degrees Celsius.

10. The system of claim 8 wherein the heater includes a heating element disposed on the exterior of the conduit.

11. The system of claim 5 further including a compressed air injector configured to sequentially inject compressed air into each of the plurality of plastic containers in order to displace a portion of the contents thereof, from which said samples of air are withdrawn into the conduit by the vacuum pump.

12. The system of claim 5 wherein the second end of the conduit includes an orifice having a diameter of approximately 200-500 microns.

13. The system of claim 1 wherein the plastic containers are plastic Polyethylene Terephthalate (PET) refillable bottles.

14. A method for testing the chemical content of a plurality of plastic containers continuously moving along a test line, the method comprising:

sequentially receiving by a detector a sample of air from each of the plurality of plastic containers as they move along the test line and detecting the chemical content of each of said samples in an environment at a first vacuum level;

providing a conduit including a first end proximate the plurality of plastic containers moving along the test line and a second end, remote from the first end; a sensor module of the detector interfacing an interior of the conduit between the first end and the second end of the conduit; and suctioning by a vacuum pump from the second end of the conduit to maintain the interior of the conduit at a second vacuum level lower than the first vacuum level and to establish an airflow to sequentially withdraw the samples of air from the plurality of plastic containers and transport the samples in the conduit to the sensor module of the detector.

15. The method of claim 14 wherein the first vacuum level is maintained at less than $1 * 10^{-3}$ Torr and the second vacuum level is maintained at less than 760 Torr.

16. The method of claim 15 wherein the plastic containers move along the test line at a rate of 300600 containers per minute and the samples of air from the plastic containers are transported in the conduit at an air sample speed.

17. The method of claim 15 including providing the detector with a detection chamber maintained at the first vacuum level and providing the sensor module with a tube having a first end disposed in the detection chamber and a second end disposed in the conduit; wherein, due to the pressure differential between the first and second ends of the tube, a portion of each of said air samples sequentially flows through the tube from the second end to the first end and is tested for chemical content by the detector.

18. The method of claim 17 wherein the tube comprises a glass lined tube with an inner diameter of approximately .18mm.

19. The method of claim 17 wherein the detector comprises a mass spectrometer for testing the chemical content if the air samples from the plurality of plastic containers.

20. The method of claim 17 further including heating the interior of the conduit.

21. The method of claim 20 wherein the interior of the conduit is heated to approximately 105 degrees Celsius.

22. The method of claim 20 wherein heating the interior of the conduit includes disposing a heating element on the exterior of the conduit.

23. The method of claim 17 further including sequentially injecting compressed air into each of the plurality of plastic containers in order to displace a portion of the contents thereof, from which said samples of air are withdrawn into the conduit by the suction provided by the vacuum pump.

24. The method of claim 17 wherein the second end of the conduit is provided with an orifice having a diameter of approximately 200-500 microns.

25. The method of claim 14 wherein the first vacuum level is maintained at approximately $5 * 10^{-5}$ Torr and the second vacuum level is maintained at approximately 40 Torr.

26. The method of claim 14 wherein the plastic containers are plastic Polyethylene Terephthalate (PET) refillable bottles.

* * * * *